US007397004B2

(12) United States Patent
Nakade et al.

(10) Patent No.: US 7,397,004 B2
(45) Date of Patent: Jul. 8, 2008

(54) PUSH-SWITCH FOR VEHICLE AND METHOD OF MANUFACTURING THE SAME

(75) Inventors: Yoshiyuki Nakade, Tsuruga (JP); Hiroyuki Kosaka, Tsuruga (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 11/051,772

(22) Filed: Feb. 4, 2005

(65) Prior Publication Data

US 2005/0167253 A1 Aug. 4, 2005

(30) Foreign Application Priority Data

Feb. 4, 2004 (JP) ..... 2004-027640

(51) Int. Cl.
*H01H 1/06* (2006.01)
*H01H 3/12* (2006.01)

(52) U.S. Cl. ..... 200/276.1

(58) Field of Classification Search ..... 200/262, 200/263, 266, 268, 269, 341, 520, 276, 537, 200/538, 279, 264
See application file for complete search history.

(56) References Cited

U.S. PATENT DOCUMENTS 5,201,410 A * 4/1993 Takano et al. ..... 200/531
6,245,445 B1 * 6/2001 Lykins, II ..... 428/626
6,512,191 B1 1/2003 Makino et al.
6,689,261 B1 * 2/2004 Iacopetti et al. ..... 204/252
6,737,598 B1 * 5/2004 Allen et al. ..... 200/537
6,861,604 B2 * 3/2005 McSwiggen ..... 200/520
7,015,580 B2 * 3/2006 Fitzsimmons et al. ..... 257/739

FOREIGN PATENT DOCUMENTS

JP 2001-297654 A 10/2001
JP 2003-151398 A 5/2003
JP 2003151398 A * 5/2003

* cited by examiner

*Primary Examiner*—Elvin Enad
*Assistant Examiner*—Lheiren Mae A Anglo
(74) *Attorney, Agent, or Firm*—Rossi, Kimms & McDowell LLP

(57) ABSTRACT

A push-switch for vehicle, and a method of manufacturing the same, including fixed contacts and movable contact brought into and out of contact in accordance with upward and downward movements of operating member, in which at least one of the contacts is provided on surfaces thereof with a plurality of fine projections and depressions produced by arcing discharges between the contacts or machining work. Contacts at a large number of points are attained by the provision of the plurality of fine projections and depressions, hence a switch capable of stable contact can be provided.

12 Claims, 4 Drawing Sheets

PUSH-SWITCH FOR VEHICLE AND METHOD OF MANUFACTURING THE SAME

FIELD OF THE INVENTION

The present invention relates to a push-switch for a vehicle for use in controlling such operations as to turn on and off brake lamps when the brake pedal of a vehicle is depressed and also relates to a method of manufacturing the switch.

BACKGROUND OF THE INVENTION

Recently, there have been widely used push-switches for vehicles, of a push-operated type, for controlling stop lamps following depressing operation of the brake pedal, or more specifically, for turning on the stop lamps when the brake pedal is depressed and turning off the lamps when the depression is released. A conventional-art example of such push-switches for vehicle (hereinafter called "PSV") will be described with reference to FIG. 3 and FIG. 4. FIG. 3 is a sectional view of PSV of conventional art. In FIG. 3, case 1 formed of an insulating resin material substantially in a box shape with an opening provided in its top plate has a plurality of fixed contacts 3 embedded in the top plate with their terminal portions 3A projecting from the underside of the top plate.

Further, there is provided conductive, metallic movable contact 4 upwardly urged by contact pressure spring 5 to elastically contact with fixed contacts 3. Thus, a plurality of fixed contacts 3 are electrically connected by movable contact 4 thereby establishing a switch contact. Further, contact pressure spring 5 in its slightly compressed state is mounted between movable contact 4 and the inner bottom of case 1.

The opening provided in the top plate of case 1 is covered by cover 7. Return spring 6 in a coil shape in its slightly compressed state is inserted between the underside of operating member 2 and the inner bottom of case 1 so that operating portion 2 is urged upward.

Cover 7 is provided with hollow cylindrical portion 7A projecting upward. Within cylindrical portion 7A, there is inserted operating shaft 2A of operating member 2 for vertical movement, while the upper end of operating shaft 2A is upwardly protruded from hollow cylindrical portion 7A. PSV is thus constructed.

PSV constructed as described above is generally mounted forwardly of the brake pedal (not shown) of a vehicle with operating shaft 2A of operating member 2 pressed in by an arm or the like. Further, terminal portions 3A of fixed contacts 3 are connected with stop lamps via connectors or the like. More specifically, in a state where the brake pedal is not depressed, operating shaft 2A of operating member 2 is pressed downward to compress contact pressure spring 5 and return spring 6 so that movable contact 4 is moved downward to be separated from fixed contacts 3. As a result, a state where a plurality of fixed contacts 3 are electrically disconnected is brought about and hence the stop lamps are turned off.

When the brake pedal is then depressed, the arm is separated from operating shaft 2A so that the pressing force acting thereon is released. As a result, operating member 2 is moved upward by the elastic restoring force of return spring 6 and, at the same time, movable contact 4 is brought into elastic contact with fixed contacts 3 by being pressed by contact pressure spring 5. Thus, the plurality of fixed contacts 3 are brought into their electrically connected state so that the stop lamps are turned on.

Electric bulbs, LEDs, or the like are generally used as the stop lamps turning on and off in the above described manner.

When electric bulbs are used, a relatively large current, e.g., around 10 A at DC 12V, is supplied. When, on the other hand, LEDs or the like are used, a relatively small value of current, e.g., 0.5A-1A at DC 12V, is supplied. Incidentally, an example of PSV having the configuration as described above is disclosed in Japanese Patent Unexamined Publication No. 2003-151398.

In above described conventional PSV, however, movable contact 4 and fixed contact 3 as shown in their sectional view of FIG. 4 are in contact with each other at one point on their surfaces. Therefore, in case of such PSV is used for stop lamps employing LEDs or the like operating with a small value of current and oxide film is formed on the surfaces of fixed contacts 3 and movable contact 4, there arises a possibility of an unstable contact occurring between the contacts.

The present invention has been made to solve such a problem encountered in conventional art and is aimed at realization of PSV providing stabilized contacts.

SUMMARY OF THE INVENTION

The present invention provides a push-switch for a vehicle including a case formed in a substantially box shape with an opening provided in its top plate, a plurality of fixed contacts embedded in the top plate of the case, an operating member accommodated within the case for movements up and down, and a movable contact disposed opposite the fixed contacts and having both end portions thereof adapted to engage with and separate from the fixed contacts in accordance with upward and downward movements of the operating member, in which at least one of the movable contact and the fixed contacts have pluralities of fine projections and depressions formed on faces thereof.

Further, the present invention provides a method of manufacturing a push-switch for a vehicle including a case formed in a substantially box shape with an opening provided in its top plate, a plurality of fixed contacts embedded in the top plate of the case, an operating member accommodated within the case for movements up and down, and a movable contact disposed opposite the fixed contacts and having both end portions thereof adapted to engage with and separate from the fixed contacts in accordance with upward and downward movements of the operating member, in which at least one of the movable contact and the fixed contacts have pluralities of fine projections and depressions formed on faces thereof, the method including a step of forming the projections and depressions by generating arcing discharges between the contacts.

DETAILED DESCRIPTION OF PREFERRED EMBODIMENT

Figure 1:
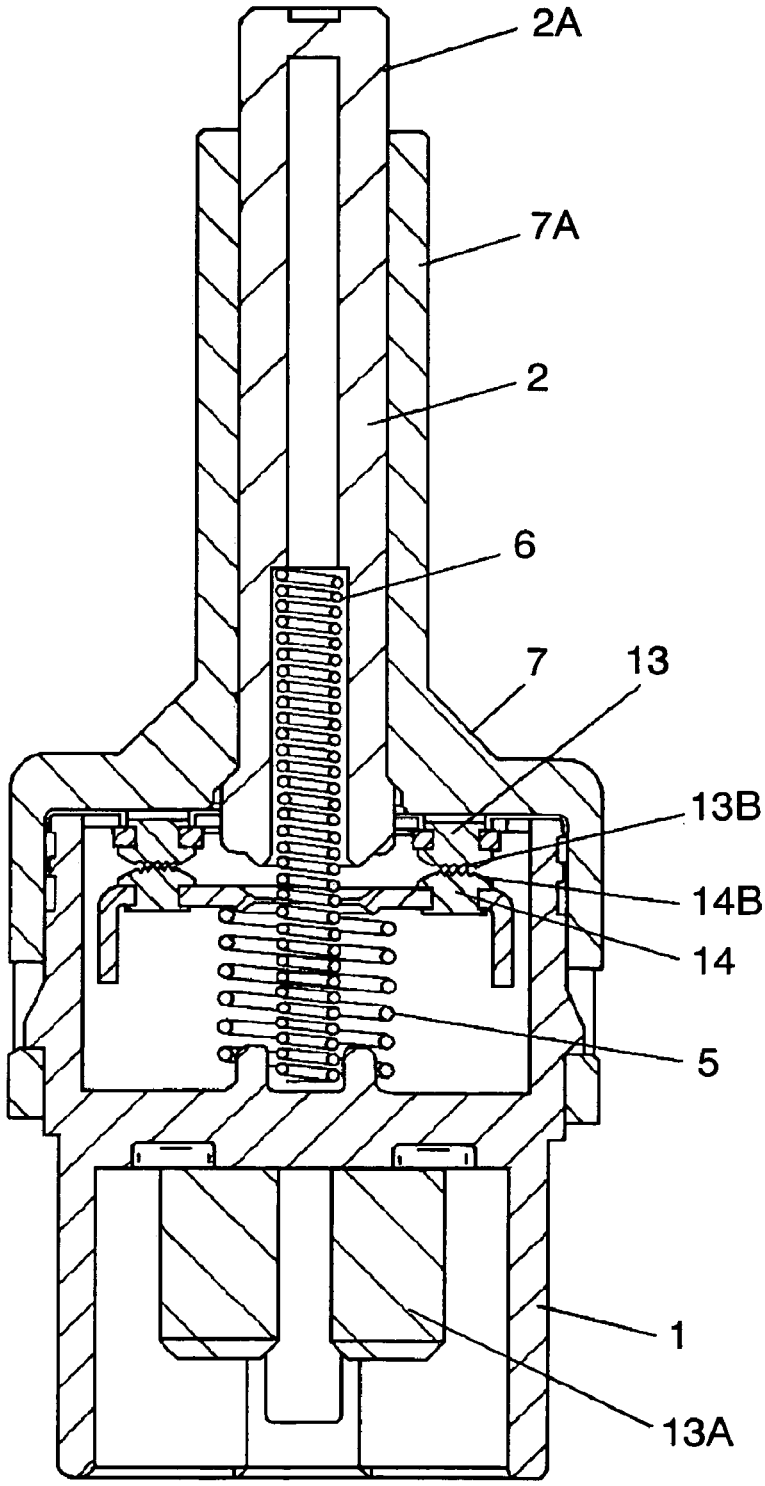
FIG. 1 is a sectional view of PSV according to an embodiment of the present invention.

An embodiment of the present invention will be described below with reference to FIG. 1 and FIG. 2. Incidentally, identical components having identical functions to those described in BACKGROUND OF THE INVENTION will be denoted by identical reference numerals and detailed description thereof will be omitted. It should further be noted that the drawings are all schematic drawings and not that showing relative positions between components in accurate dimension.

EMBODIMENT

Case 1 made of an insulating resin has a substantially box shape with an opening provided in its top plate, and has a plurality of fixed contacts 13 embedded in the top plate with terminal portions 13A thereof projecting from the underside of the top plate.

Operating member 2 is made of an insulating resin and has a substantially cylindrical shape.

Fixed contact 13 made of a silver-copper alloy is formed substantially in a dome shape. Further, a plurality of fine projections and depressions 13B of dimensions from a few tens of μm to several hundred μm are provided on its surface as shown in FIG. 2.

Further, there is disposed movable contact 14 of conductive metal as elastically pressed on plurality of fixed contacts 13 from below by contact pressure spring 5, which is mounted between movable contact 14 and the inner bottom of case 1 in its slightly compressed state.

Thus, the plurality of fixed contacts 13 are electrically connected by movable contact 14 and thereby a switch contact is established.

Movable contact 14 formed substantially in a dome shape is also made of a silver-copper alloy and provided with a plurality of fine projections and depressions 14B of dimensions from a few tens of μm to several hundred μm on its surface.

Thus, by virtue of the provision of pluralities of fine projections and depressions 13B and 14B, fixed contact 13 and movable contact 14 are placed in contact with each other at a number of points on the surfaces of the contacts. With regard to the dimensions of the fine projections and depressions, when they are smaller than a few tens of μm, substantially no meritorious effects of the present invention are observed and, on the other hand, when they are larger than several hundred μm, it is not preferable because the area of contact is then reduced. Cover 7 covers the opening in the top plate of case 1.

Return spring 6 in a coil shape is mounted between the underside of operating member 2 and the inner bottom of case 1 in its slightly compressed state so that operating member 2 is urged upward. Further, cover 7 has hollow cylindrical portion 7A projecting upward and, within hollow cylindrical portion 7A, there is inserted operating shaft 2A of operating member 2 for vertical movement. The upper end portion of operating shaft 2A is protruded upward from hollow cylindrical portion 7A. Thus, PSV is constructed.

Examples of forming the plurality of fine projections and depressions 13B and 14B on the surfaces of fixed contacts 13 and movable contact 14 will be described below. A predetermined load circuit carrying a relatively large value of voltage and current, for example, of around DC 12V×50 A, is connected to terminal portions 13A projecting from the outer bottom of case 1. Then, operating shaft 2A is moved up and down to make and break the contacts twenty times or so, whereby arc discharges are produced between the contacts. Thus, fine projections and depressions 13B and 14B can be formed easily. Otherwise, a load circuit may be connected to terminal portions 13A and low-frequency vibrations with amplitude of 1 mm or so and at a cycle of 30-40 Hz may be applied thereon 5 to 10 seconds to thereby cause arc discharges between electrodes. Thus, projections and depressions 13B and 14B can be formed relatively uniformly.

Further in the process of forming a contact from a contact member, it is normally practiced to form a contact member, previously processed in a cylindrical shape, into a rivet contact shape by pressing the contact member with the use of a punch dye. Then, if the working dye is originally shaped to have depressions and projections on its surface, it is made relatively easy to provide fine projections and depressions 13B, 14B.

Further, during a process to fix a contact onto a terminal by compression bonding or after the process of the fixing by compression bonding, pressing work to provide depressions and projections may be made by the use of a punch. Thereby, fine projections and depressions 13B, 14B can be provided relatively easily.

Such PSV constructed as described above is generally installed in front of the brake pedal of a vehicle with its operating shaft 2A of operating member 2 pressed in by an arm or the like. Further, terminal portions 13A of fixed contacts 13 are connected with stop lamps via connectors or the like.

In a state where the brake pedal is not depressed, operating shaft 2A of operating member 2 is pressed down so that contact pressure spring 5 and return spring 6 are compressed. As a result, movable contact 14 is moved downward to be separated from fixed contacts 13. Since the plurality of fixed contacts 13 come to be electrically disconnected, the stop lamps are turned off.

When the brake pedal is then depressed, the arm is left from operating shaft 2A to release the pressing force thereon, and hence operating member 2 is moved upward by the elastic restoring force of return spring 6. As a result, movable contact 14 is pushed by contact pressure spring 5 to come into elastic contact with fixed contacts 13. Thus, the plurality of fixed contacts 13 come to be electrically connected so that stop lamps are turned on.

Figure 2:
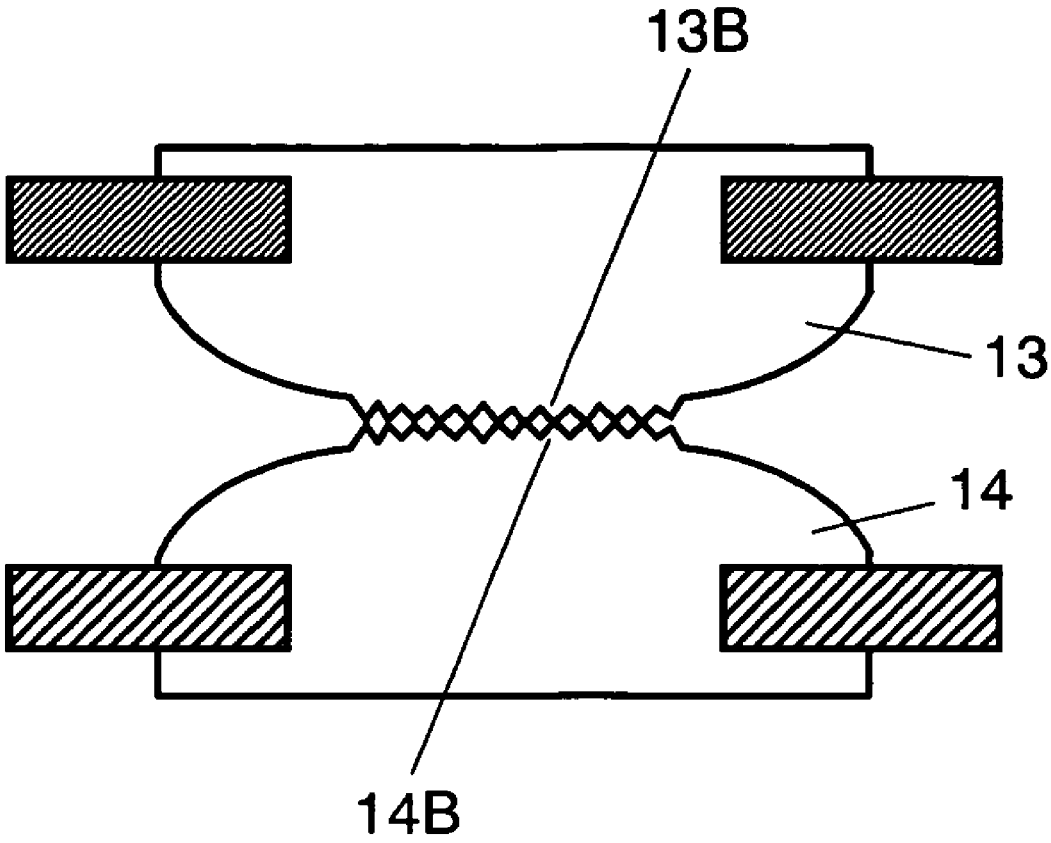
FIG. 2 is an enlarged sectional view of contact portions of PSV according to the embodiment of the invention.
Figure 3:
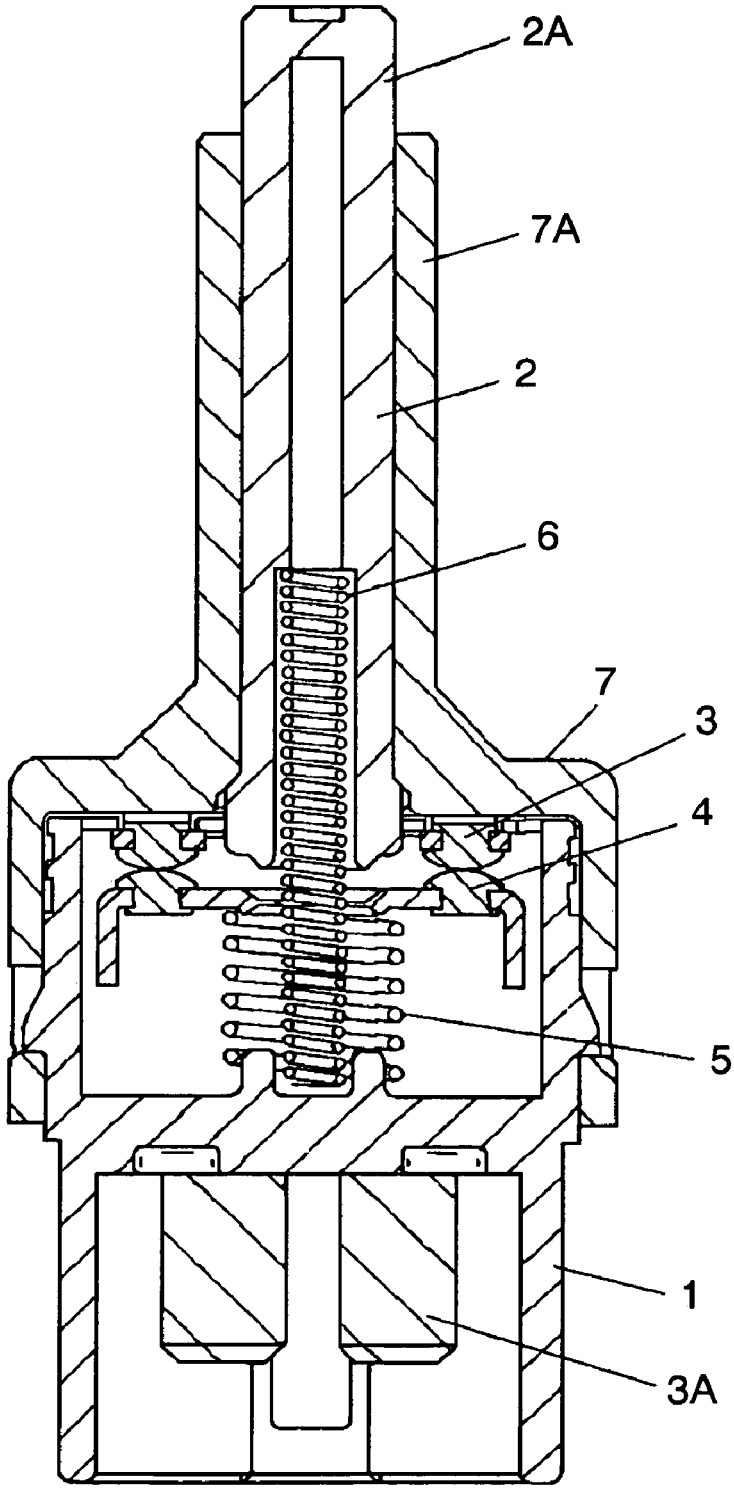
FIG. 3 PRIOR ART
FIG. 3 is a sectional view of conventional PSV.
Figure 4:
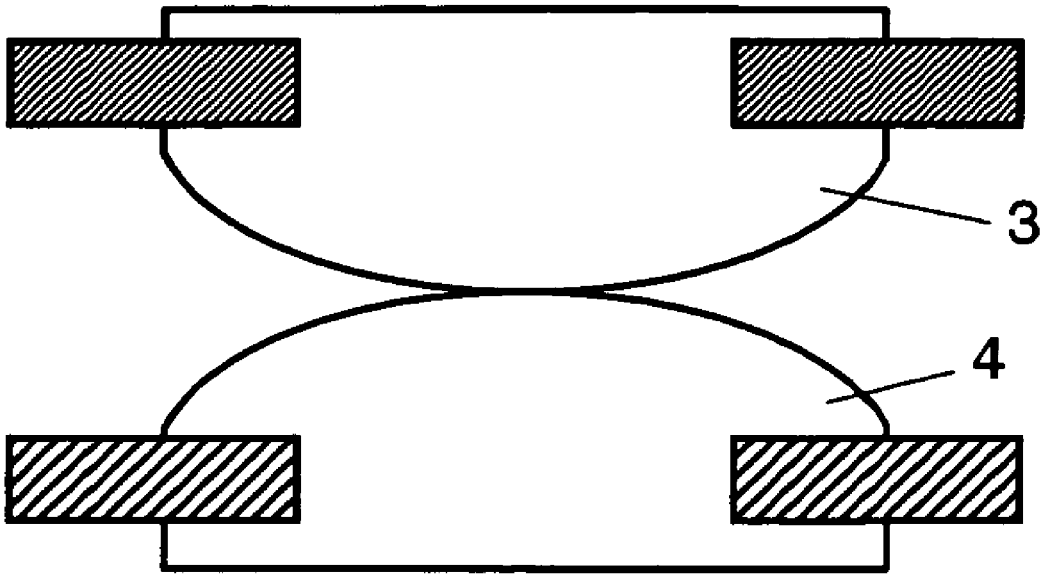
FIG. 4 PRIOR ART
FIG. 4 is an enlarged sectional view of contact portions of conventional PSV.

At this time, by virtue of a plurality of fine projections and depressions 13B and 14B formed on their surfaces, fixed contact 13 and movable contact 14 substantially formed in a dome shape are in contact with each other at a number of points on the contacting surfaces as shown in FIG. 2.

In other words, increased contacting pressure is applied on each point, and hence stabilized contact can be attained even when oxide films or the like are formed on the surfaces of the contacts.

Further, every time the points of contact are brought into contact and out of contact by the switching operation, the points of contacts are changed and, also, the projections and depressions make sliding contact. As a result, the so-called "wiping," no matter how small it may be, is repeated while operations for making and breaking contact are performed.

According to the present embodiment, as described above, PSV is configured to have a plurality of fine projections and depressions 13B, 14B provided on the surfaces of fixed contacts 13 and movable contact 14 which make and break contact in accordance with up-and-down movements of operating member 2. Accordingly, by virtue of the plurality of fine projections and depressions 13B and 14B, contacts are made at a number of points on the surfaces of contact. In other word, the contact pressure applied on each point is increased and a multi-point contact with a high contacting pressure applied thereon is achieved, and hence, even if oxide films are formed on the surfaces of the contacts, PSV providing stabilized contact can be realized.

Further, by forming projections and depressions on the contact surfaces by arc discharges produced between contacts, the fine projections and depressions can be formed relatively easily.

Further, formation of the fine projections and depressions on the movable contact or fixed contacts can be attained relatively easily by carrying out it during the process of making the contact member or during the process of securing a contact onto a terminal.

Incidentally, the meritorious effect of the present invention is obtained if, at least, one of fixed contact 13 and movable contact 14 is provided with such projections and depressions on the surface thereof. As the material of fixed contacts 13 and movable contact 14, silver-system materials are chiefly used. In the case of switches for motor vehicles, use of a silver-copper alloy is preferred to use of a silver-cadmium oxide alloy and the like. It is because in the latter case, transition to produce projections on one side and depressions on the other side occurs under application of DC voltage and current, while in the former case, i.e., when the silver-copper alloy is used, no such transition occurs. The silver-copper alloy is preferable as the contact member also from the point of view of making projections and depressions 13B and 14B fine and uniform.

As the compositions of the alloy as the material of contacts, those containing 60-80% silver by weight and 20-40% copper by weight, with addition of several % nickel, magnesium, tin oxide, indium oxide, or the like by weight are preferred in view of usability and formation of projections and depressions.

According to the present invention, as described above, it is attained to provide PSV allowing the contacts thereof to be made stably.

Further, the method of manufacturing PSV of the present invention is capable of providing PSV of a simple configuration allowing contacts thereof to be contacted in a stable manner.

In the foregoing embodiment, a plurality of fixed contacts are used; however, a single fixed contact can be used and the same meritorious effect of the present invention is obtained.

What is claimed is:

1. A method of manufacturing a push-switch for a vehicle comprising:

embedding a fixed contact within a case formed in a substantially box shape with a top plate provided with an opening;

providing a movable contact within the case so as to oppose the fixed contact and to engage with and separate from the fixed contact at both end portions thereof;

accommodating an operating member within the case so as to penetrate the case at the opening, the operating member being configured to move the movable contact in the case;

applying a predetermined value of voltage between the movable contact and the fixed contact in order to form a plurality of fine projections and depressions on a surface of at least one of the movable contact and the fixed contact by arcing discharges; and moving the operating member to have the movable contact engage with and separate from the fixed contact in a condition while keeping the voltage between the movable contact and the fixed contact applied.

2. The method of manufacturing the push-switch for a vehicle according to claim 1, wherein at least one of the movable contact and the fixed contact is made of a silver-copper alloy.

3. The method of manufacturing a push-switch for a vehicle according to claim 1, wherein the fine projections and depressions are formed with dimensions from tens of microns to hundreds of microns.

4. A method for forming a plurality of fine projections and depressions on a surface of at least one of a movable contact and a fixed contact of a push-switch for a vehicle having an operating member, the push-switch including a case formed in a substantially box shape with a top plate provided with an opening, the fixed contact being embedded in the case, the movable contact being disposed opposite the fixed contact and having both end portions configured to engage with and separate from the fixed contact, and the operating member being accommodated within the case so as to penetrate the case at the opening and being configured to move the movable contact in the case, the method comprising:

applying a predetermined value of voltage between the movable contact and the fixed contact in order to form the plurality of fine projections and depressions on a surface of at least one of the movable contact and the fixed contact by arcing discharges; and moving the operating member so as to have the movable contact engage with and separate from the fixed contact in a condition while keeping the voltage between the movable contact and the fixed contact applied.

5. The method for forming a plurality of fine projections and depressions on a surface of at least one of a movable contact and a fixed contact of a push-switch for a vehicle according to claim 4, wherein the fine projections and depressions are formed with dimensions from tens of microns to hundreds of microns.

6. The method for forming a plurality of fine projections and depressions on a surface of at least one of a movable contact and a fixed contact of a push-switch for a vehicle according to claim 4, wherein the voltage between the movable contact and the fixed contact is 12 V of direct current of 50 A.

7. A method for forming a plurality of fine projections and depressions on a surface of at least one of a movable contact and a fixed contact of a push-switch for a vehicle having an operating member, the push-switch including a case formed in a substantially box shape with a top plate provided with an opening, the fixed contact being embedded in the case, the movable contact being disposed opposite the fixed contact and having both end portions configured to engage with and separate from the fixed contact, and the operating member being accommodated within the case so as to penetrate the case at the opening and being configured to move the movable contact in the case, the method comprising:

applying a predetermined value of voltage between the movable contact and the fixed contact in order to form the plurality of fine projections and depressions on a surface of at least one of the movable contact and the fixed contact by arcing discharges; and applying vibrations on the push-switch in a condition keeping the voltage between the movable contact and the fixed contact applied.

8. The method for forming a plurality of fine projections and depressions on a surface of at least one of a movable contact and a fixed contact of a push-switch for a vehicle according to claim 7, wherein the fine projections and depressions are formed with dimensions from tens of microns to hundreds of microns.

9. The method for forming a plurality of fine projections and depressions on a surface of at least one of a movable contact and a fixed contact of a push-switch for a vehicle according to claim 7, wherein the vibrations are defined by an amplitude of 1 mm and a cycle of 30 to 40 Hz that is applied for 5-10 seconds.

10. A method of manufacturing a push-switch for a vehicle comprising:

embedding a fixed contact within a case formed in a substantially box shape with a top plate provided with an opening;

providing a movable contact within the case so as to oppose the fixed contact and to engage with and separate from the fixed contact at both end portions thereof;

accommodating an operating member within the case so as to penetrate the case at the opening, the operating member being configured to move the movable contact in the case;

applying a predetermined value of voltage between the movable contact and the fixed contact in order to form a plurality of fine projections and depressions on a surface of at least one of the movable contact and the fixed contact by arcing discharges; and applying vibrations on the push-switch in a condition while keeping the voltage between the movable contact and the fixed contact applied.

11. The method of manufacturing a push-switch for a vehicle according to claim 10, wherein at least one of the movable contact and the fixed contact is made of a silver-copper alloy.

12. The method of manufacturing a push-switch for a vehicle according to claim 10, wherein the fine projections and depressions are formed with dimensions from tens of microns to hundreds of microns.

* * * * *